US006712255B2

(12) United States Patent
Dittrich et al.

(10) Patent No.: US 6,712,255 B2
(45) Date of Patent: Mar. 30, 2004

(54) SETTING TOOL

(75) Inventors: Tilo Dittrich, Feldkirch (AT); Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/365,817

(22) Filed: Feb. 12, 2003

(65) Prior Publication Data

US 2003/0155396 A1 Aug. 21, 2003

(30) Foreign Application Priority Data

Feb. 15, 2002 (DE) ..... 102 06 588

(51) Int. Cl.[7] ..... B25C 1/14
(52) U.S. Cl. ..... 227/10; 227/76; 89/35.01
(58) Field of Search ..... 227/9, 10, 11, 227/130, 76, 136; 89/35.01

(56) References Cited

U.S. PATENT DOCUMENTS 3,743,159 A * 7/1973 Schneider ..... 227/10
4,051,990 A * 10/1977 Chromy et al. ..... 227/10
4,890,404 A * 1/1990 Ferri ..... 42/57
5,170,922 A * 12/1992 Ehmig et al. ..... 227/8
5,749,509 A * 5/1998 Remerowski ..... 227/10
5,829,661 A * 11/1998 Hirtl et al. ..... 227/10
6,159,328 A * 12/2000 Gaikoski et al. ..... 156/269
6,237,747 B1 * 5/2001 Gantner et al. ..... 198/747

* cited by examiner

*Primary Examiner*—Scott A. Smith
(74) *Attorney, Agent, or Firm*—Sidley Austin Brown & Wood, LLP

(57) ABSTRACT

A propellant charge-operating setting tool for driving fastening elements and including a housing (11), a setting mechanism (12) located in the housing (11) and actuated in response to ignition of a propellant charge (24) for driving in a fastening element, and a device (30, 40, 50, 60, 70) for cutting a used portion of a propellant charge-carrying magazine strip (22).

20 Claims, 9 Drawing Sheets

SETTING TOOL

BACKGROUND OF THE INVENTION

1. Field of the Invention

The present invention relates to a propellant charge-operated setting tool for driving in fastening elements, such as nails, bolts, pins, etc. . . in a constructional component and including a housing, and a setting mechanism located in the housing and actuated in response to ignition of a propellant charge, which is carried by magazine strip displaceable in the setting tool, for driving in a fastening element.

2. Description of the Prior Art

The propellant charge, which is used in the setting tools of the type described above, is formed as a pill or cartridge of a powder fuel. A plurality of such pills or cartridges is arranged on a magazine strip. Magazine strips are pushed through a feeder provided on a setting tool, with a single charge being received at a time in a cartridge socker. The magazine strip with blisters of pills or cartridges is automatically displaced through the setting tool upon completion of a setting process for placing a new charge in the cartridge socket.

A setting tool of the type described above is disclosed in German Publication DE 199 01 268 A1.

In order to be able to conduct a greatest possible number of setting processes without the replacement of the necessary cartridges, blisters, or magazine strips, there was proposed to use very long magazine strips.

U.S. Pat. No. 4,204,473 discloses a cartridge strip with a large number of propellant charges The cartridge strips are arranged in a magazine box. The cartridge or magazine strips in this magazine box are arranged in layers.

U.S. Pat. No. 6,053,108 discloses an arrangement of pill-shaped charges in a blister or magazine strip, and an arrangement of powder charges in a cartridge strip. The magazine or cartridge strip contains a large number of charges and is unwound along a spiral.

The drawback of the use of such long magazine strips, such as cartridge of blister strips, in setting tools consists in that they make handling of the setting tools very difficult when a large section of the used portion of the magazine strip extends from or is suspended from a setting tool.

Accordingly, an object of the present invention is to provide a setting tool of the type described above in which the drawback of the prior art is eliminated and in which a long magazine strip can be used without adversely affecting handling of the setting tool.

SUMMARY OF THE INVENTION

This and other objects of the present inventions which will become apparent hereinafter, are achieved by providing the setting tool with a device for cutting the magazine strip.

The cutting device permits to separate an empty section, of the magazine strip, e.g., of a cartridge or blister strip from a usable section of the magazine strip. The cutting device in this way prevents formation of long empty ends of magazine strip suspendable from the setting tool and which made the handling of the tool more difficult. The cutting devices can be, e.g., of a mechanical type or also include electrical components for control purposes and for an automatic start of a cutting process. The use of a cutting device simultaneously permits to eliminate, in the setting tool, a storage space for the used section of the magazine strip, which otherwise would have been needed and which occupies a large space in the setting tool.

Advantageously, the cutting device has at least one cutting element arranged behind the cartridge socket in the displacement direction of the magazine strip, so that it always cuts the used portion of the magazine strip. Ideally, the cutting element is so arranged that it effects transportation of the magazine strip during the cutting process while severing the magazine strip.

To prevent suspension from the setting tool of non-yet used magazine strip, specific magazine-receiving means is provided in the setting tool in which the magazine strip can be placed.

According to one advantageous embodiment of the present invention, the magazine-receiving means is formed as a magazine comportment displaceable between a first position corresponding to an operational position of the setting tool, and a second position corresponding to a position of the setting tool in which insertion/removal of the magazine strip is possible.

An arrangement of a magazine strip in a magazine or magazine box from which the strip can be pulled out, advantageously insures a reliable support and transportation of magazine strips. Further, an easy handling of the setting tool is also insured.

Advantageously, the cutting element can be mounted on the magazine compartment and be fixedly connected therewith. When the magazine compartment is displaced from the operational position to a removal position, the cutting element is displaced through the displacement path of the magazine strip, cutting off the used portion of the magazine strip, so that the used portion falls out of the setting tool. The magazine compartment functions similar to a drawer which is used for inserting the magazine box into the setting tool and for removal the magazine box from the setting tool. The movement of the magazine compartment is similar to that of a magazine of an automatic gun. By the time the magazine box is removed from the tool, the cartridge or magazine strip is cut out. It is advantageous when the used portion of the magazine strip can be easily removed only with a partial movement of magazine strip. In this case the magazine strip is cut out by a blade provided on the magazine compartment.

According to a further advantageous embodiment of the present invention, the setting tool has two housing parts movable relative to each other. The two parts can move relative to each other as a result of recoil of the setting tool upon ignition of the propellant charge. According to the invention, the cutting element, e.g., a blade is so arranged on one of the housing parts that it is displaced through the displacement path of the magazine strip in response to movement of the two parts relative to each other which is caused by the recoil of the tool.

A particular advantage of cutting of the used portion of the strip as a result of the recoil of the tool consists in that a user of the setting tool does not need initiate a cutting process after a setting step as the magazine strip is already cut automatically, with the cut-out blisters and/or cartridges falling out.

The adverse effect of recoils on the tool user, and cutting off the magazine strip upon pressing of the tool against an object is prevented by arranging a damping device that can be formed, e.g., of a damping element and a spring element, between the two housing parts for preventing a relative movement therebetween. When one of the housing parts includes a handle, with the use of the dampening device, no additional damping means is needed in the interior of the tool, which simplifies the construction of the setting tool.

Further with the described embodiment, the entire recoiling mass of the tool is used for effecting the cut, which permits to make the tool relatively light.

According to another advantageous embodiment of the present invention, the cutting device comprises a manually actuated actuation lever and a pivotal cutting element that upon actuation of the actuation lever, is displaced through the displacement path of the magazine strip for cutting the used portion of the magazine strip. The actuation lever and the cutting element are brought back into their initial position by an appropriate spring element. With this embodiment, a tool user can effect cutting-off of the used section only then when the suspended portion interferes with the handling of the setting tool.

Advantageously, the actuation lever and the pivotal cutting element are formed as a one-piece part supported on a single pivot axle. The cutting device of this type can be easily manufactured and is relatively inexpensive.

Besides this simple mechanical cutting device, other manually actuated cutting devices without a pivotal lever can be used. E.g., mechanical cutting devices with which the cutting element, e.g., a blade, performs a translational movement through the displacement path of the magazine strip.

According to a further advantageous embodiment of the present invention, the cutting device or at least the cutting element are electronically controlled. The advantage of an electronically controlled cutting element or a complete electronic cutting device consists in that the cutting process can be effected without any physical intervention of a tool user, with the cutting process being controlled in accordance with predetermined criteria. E.g., the following logical condition can lead to the initiation of a cutting process. E.g., the cutting process can be initiated after, e.g., at least an X number of cartridges have been used or fired, after a setting process ends, or upon actuation of a trigger or an actuation button. Such control eliminates excessive cuttings.

According to a further advantageous embodiment of the present invention, an electronic cutting device or an electronically controlled cutting element has an electrical drive, e.g., an electric motor or a solenoid. The electrical drive can be associated with a gear set. Thus, when the electrical drive has a small power capacity and a high-speed motor, a gear set with a high transmission ratio can drive a rotatable cutting element. The control of the electric motor and the transmission ratio can be so selected that a rotatable knife would perform exactly one revolution per cut.

It is advantageous when the cutting element is formed as an eccentrically rotatable cutting body, e.g., as a spiral knife or a spiral blade. Preferably, the rotatable cutting body or the spiral knife has a recess that would permit passing of propellant charges or blister cartridges during displacement of the magazine strip. With this embodiment of a cutting device, complicated movements of the cutting element can be avoided and which otherwise would have to be effected by an appropriate control of the electrical drive.

According to yet another advantageous embodiment of the present invention, the electronically controlled cutting element is formed as a thermal cutting element, e.g., as an incandescent wire or a heatable blade. With such a cutting element, e.g., the incandescent wire, the magazine strip can be melt through at a desired point in time. Advantageously, the thermal cutting element is spring-biased toward the magazine strip. It is further advantageous when a feeler or scanning element, which cooperates with the thermal cutting element, is provided. The feeler element can scan cutting marks provided on the magazine strip. The thermal cutting element or the incandescent wire usually slides over the magazine strip, without being hot, or is spaced by a small distance from the magazine strip. The scanning element or the feeler is usually made of an electrically insulating material and also slides over the magazine strip, which is made of a plastic material, under an action of a biasing force. When a cutting mark which, e.g., coincides with transportation holes provided on the magazine strip, is scanned, the feeler falls into a hole(s), causing lowering of the cutting element. If the cutting element is not under current, i.e., that wire does not glow, the wire would prevent further falling of the feeler into the transportation hole. The magazine strip can be further advanced into a longitudinal direction If a cut should be made, and the wire is hot, the magazine strip would be molten through.

According to a yet another advantageous embodiment of the present invention, the cutting element is formed of two, inclined to each other cutters forming together an angle which is not equal 180°. With such configuration of the cutter arrangement, with the cutters being inclined toward each other or away from each other, the cutting process can be effected with a smaller expenditure of force that with a cutter(s) not inclined to the magazine strip.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
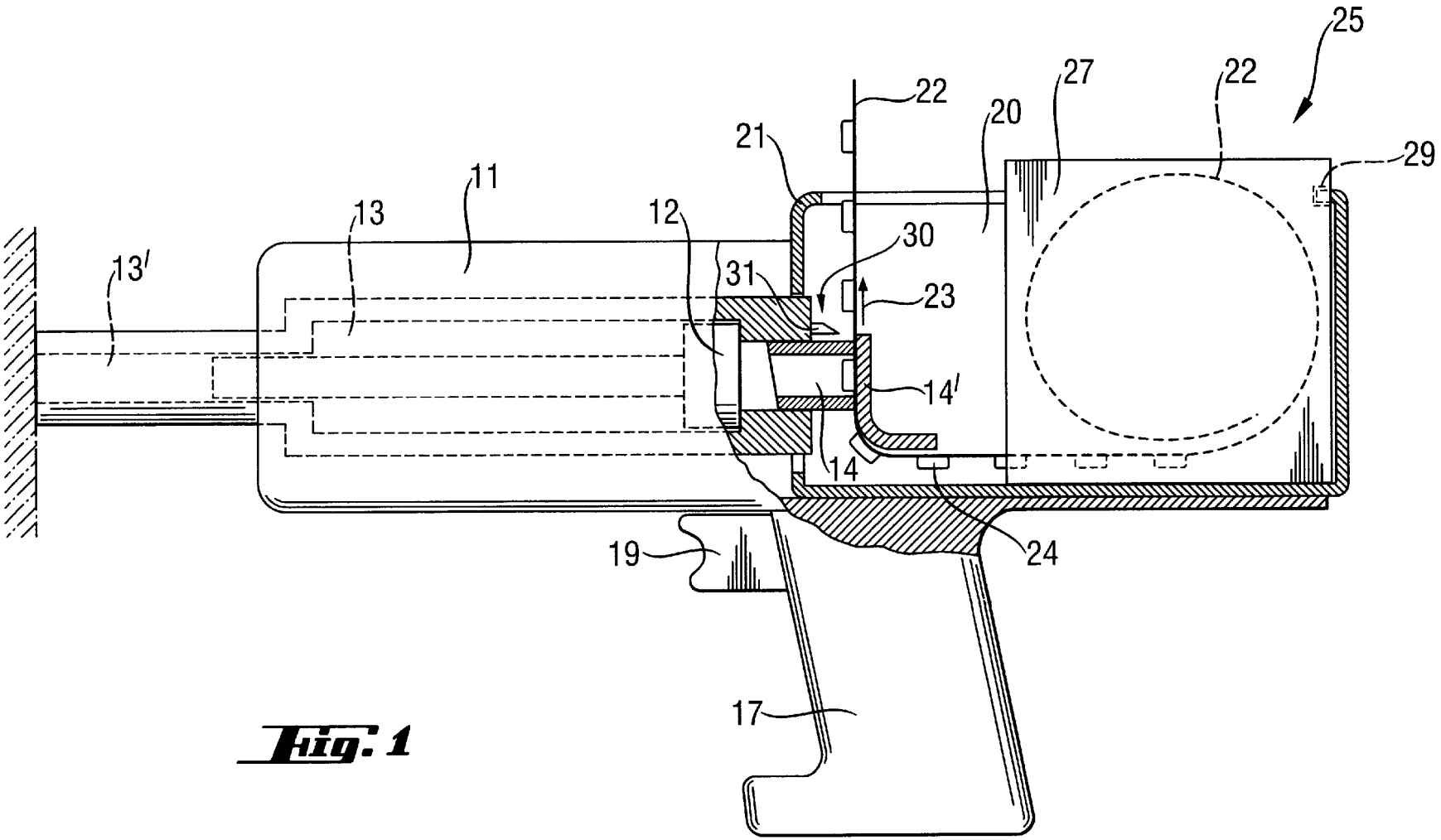
FIG. 1. A schematic, partially cross-sectional side view of a first embodiment of a setting tool according to the present invention in an operational position thereof with a magazine of to-be-set fastening elements located in the setting tool.
Figure 2:
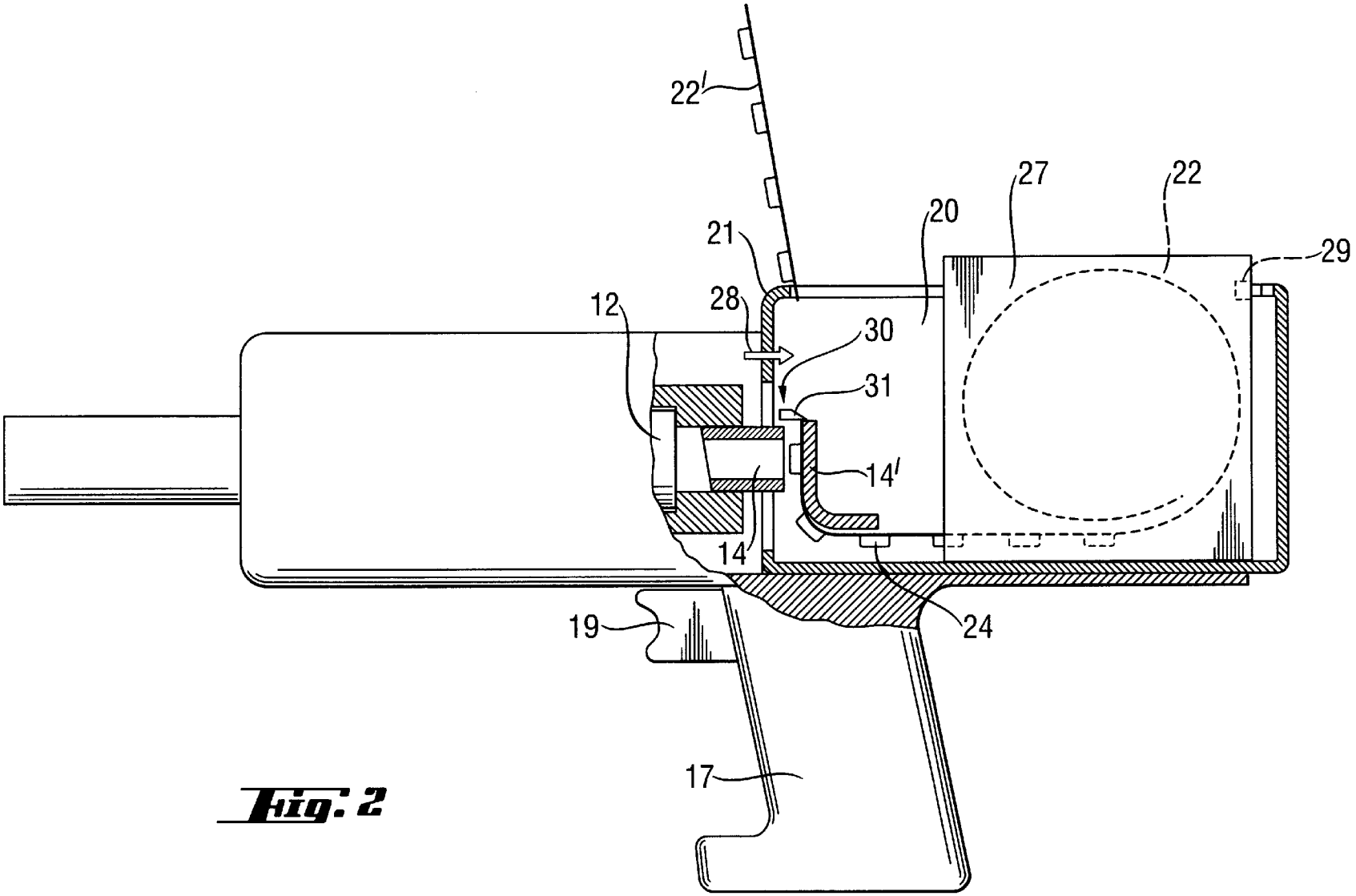
FIG. 2. A schematic, partially cross-sectional, side view of the setting tool shown in FIG. 1 in its transitional position between the operating position and a position in which the magazine with to-be-set fastening elements is removed.
Figure 3:
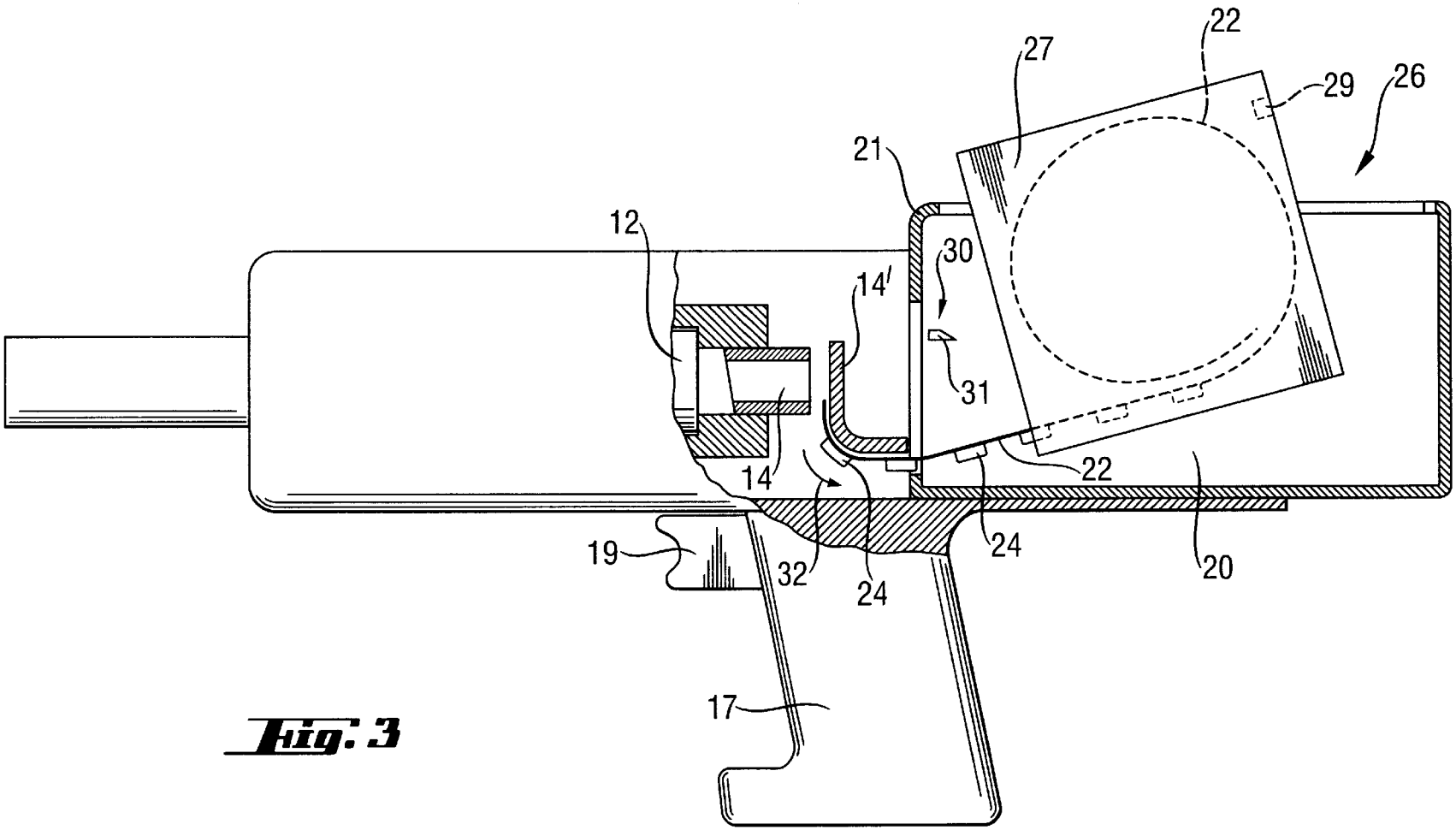
FIG. 3. A schematic, partially cross-sectional, side view of the setting tool shown in FIG. 1 in the position in which the magazine with to-be-set fastening elements has been removed.

A setting tool according to a first embodiment, which is shown in FIGS. 1–3, has a housing 11 and a setting mechanism 12 located in the housing 11. The setting mechanism 12 includes a drive piston 12 located in a piston guide 13 or in a piston chamber, and a cartridge chamber or a cartridge socket 14 in which a cartridge or a propellant charge 24 is received. Upon ignition of the located in the cartridge socket 14, propellant charge 24, the drive piston 12 would be driven away from the cartridge socket 14 by explosive gases and would be able to perform a setting operation, e.g., to drive a nail or a bolt, which is located in a bolt guide 13, into a constructional component. The inventive setting tool, which is shown in the drawings, further includes a handle 17, on which a trigger 18 or other type of an actuator is provided. Upon being actuated, the trigger 18 initiates the ignition of the propellant charge 24 located in the cartridge socket 14. The setting tool further includes a magazine compartment 21 having magazine-receiving means 20 in which a magazine box 27 is received.

The setting tool is shown in FIG. 1 in its operational position 25 in which actuation of the setting tool is possible. In the position 25, the magazine box 27 cannot be removed from the setting tool because it is secured in the magazine compartment 21 with a locking element 29. In addition to the locking element 29, other locking or fastening means can be provided which can be arranged in the setting tool independently of the magazine compartment 21. The magazine box 27 contains a magazine strip 22 that can be pulled out from the magazine box 27. The propellant charges 24 are arranged on the magazine strip 22. The magazine strip 22 can be formed, e.g., as a blister strip on which pill-shaped propellant charges 24 are arranged. The magazine strip can also be formed as a cartridge strip with cartridges with a powder charge being arranged on the cartridge strip.

In the operational position of the setting tool, not yet ignited propellant charge 24 is located in the cartridge socket 14, with the propellant charge 24 being sealingly supported against the bottom 14' of the cartridge socket 14 when the setting tool is pressed against a constructional component.

The magazine compartment 21 forms part of a cutting device which, in addition to the magazine compartment, includes a blade or cutter 31 fixedly connected with the magazine compartment 21. The magazine compartment 21 is displaceably arranged in the setting tool.

In FIG. 2, it is shown that the magazine compartment 21 is displaced in a direction shown with an arrow so that the cutter or blade 31 can be displaced across of a displacement path 23 of the magazine strip 22' for cutting the magazine strip 22'. The separated end of the magazine strip 21 can be removed from the setting tool or it falls out. In this transitional or intermediate position of the setting tool, the locking element 29 is already released. However, as discussed above, there can be provided other locking or retaining means that could retain the magazine box 27 in the setting tool.

In the position shown in FIG. 3, the magazine compartment 21 is pulled all the way backward to its second position 26 so that the magazine box 27 can be removed from the magazine compartment 21. The cartridge bottom 14' is so far removed from the cartridge socket 14 that the propellant charge 24 still located in the cartridge socket 14 can be withdrawn from the socket 14, and the magazine strip 22 can be pulled in a direction of arrow 32 from the setting tool.

It should be pointed out that the user can cut the magazine strip 22 in a simple manner, without withdrawing the magazine box 27, by displacing, for a short time, the magazine compartment 21 into the position shown in FIG. 2 and then displacing it back into the position.

Figure 4:
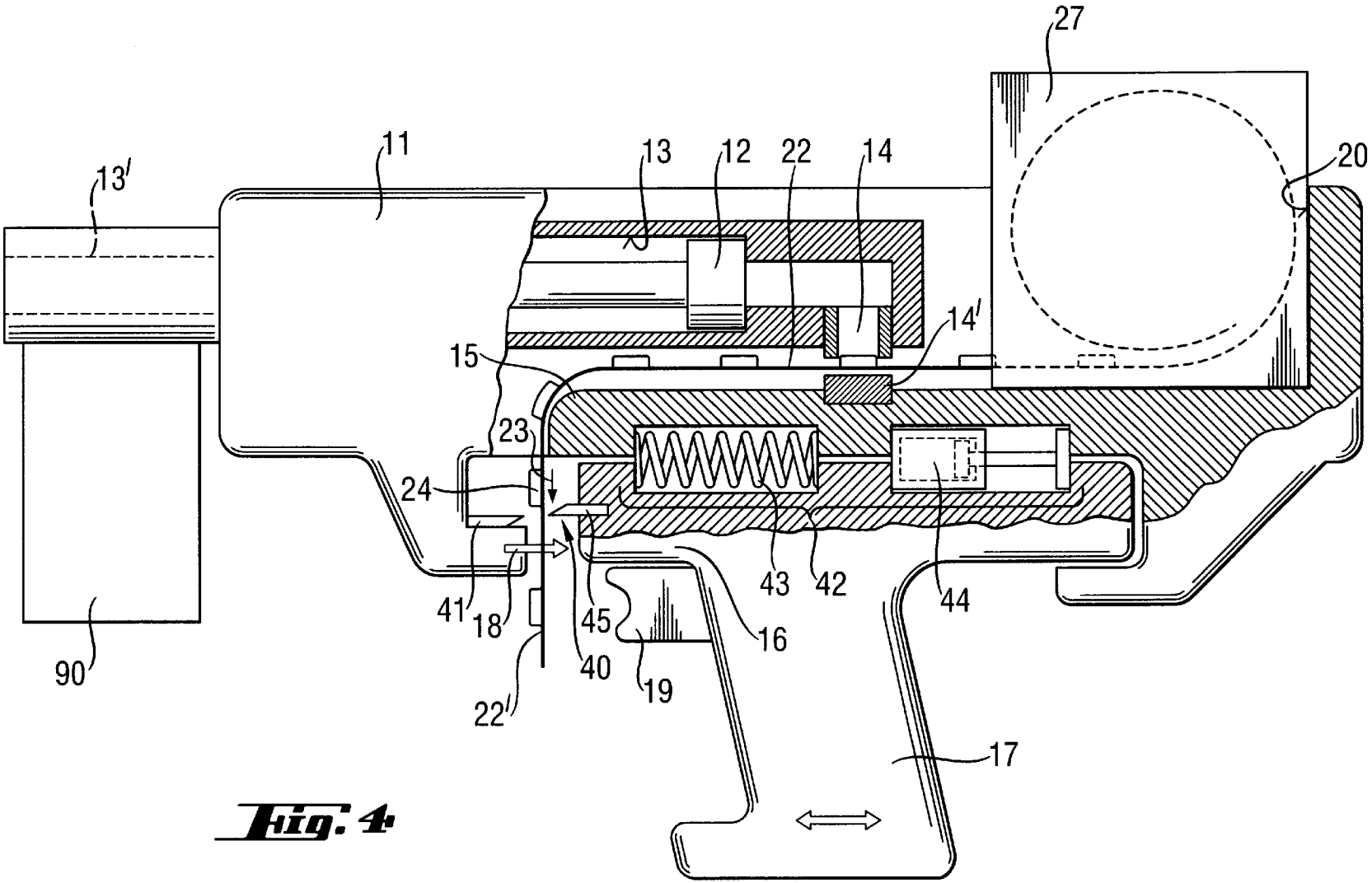
FIG. 4. A schematic, partially cross-sectional side view of a second embodiment of a setting tool according to the present invention in an operational position thereof with a magazine of to-be-set fastening elements located in the setting tool.

FIG. 4, as discussed above, shows another embodiment of a setting tool according to the present invention. In the embodiment shown in FIG. 4, the setting mechanism 12 includes, in addition to the elements discussed with reference to FIGS. 1–3, a magazine 90 for fastening elements, such as nails, bolts, etc. . . , which is attached to the bolt guide 13'.

In the setting tool shown in FIG. 4, the magazine receiving means 20 is located directly in housing 11 of the setting tool. The setting tool has two housing parts 15 and 16. The setting mechanism 12 is located in the housing part 15, and the housing part 16 includes the handle 17 with the trigger 19. A damping device 42, which is formed, in the embodiment of the setting tool shown in FIG. 4 of a spring 43 and a damping element 44, is arranged between the two housing parts 15 and 16. The object of the damping device 42 is to damp the recoils of the setting tool upon explosion of the propellant charge 24 in the cartridge socket 14. Another object of the damping device 42 is to insure a positional stability of the housing part 15 and 16 relative to each other when the setting tool is pressed against a constructional component. The magazine strip 22 is guided in the setting tool of FIG. 4 through a free space or gap between the housing parts 15, 16 and outside of the setting tool. A cutting device 40 is provided in the region of the free space between the housing parts 15 and 16. In the embodiment shown in FIG. 4, the cutting member 41 provided on the first housing part 15, and a cutting member 45 is provided on the second housing part 16 and located approximately opposite the cutting member 41. Upon movement of the housing part 15 and 16, upon explosion of the propellant charge 24 in the cartridge socket 14, toward each other in direction of arrow 38, the cutting member 41 is displaced toward the magazine strip 22 pushing it toward the second cutting member 45, so that upon further movement of the housing parts 15 and 16 toward each other, a portion of the magazine strip 22, which is suspended from the setting tool, is cut out.

Figure 5:
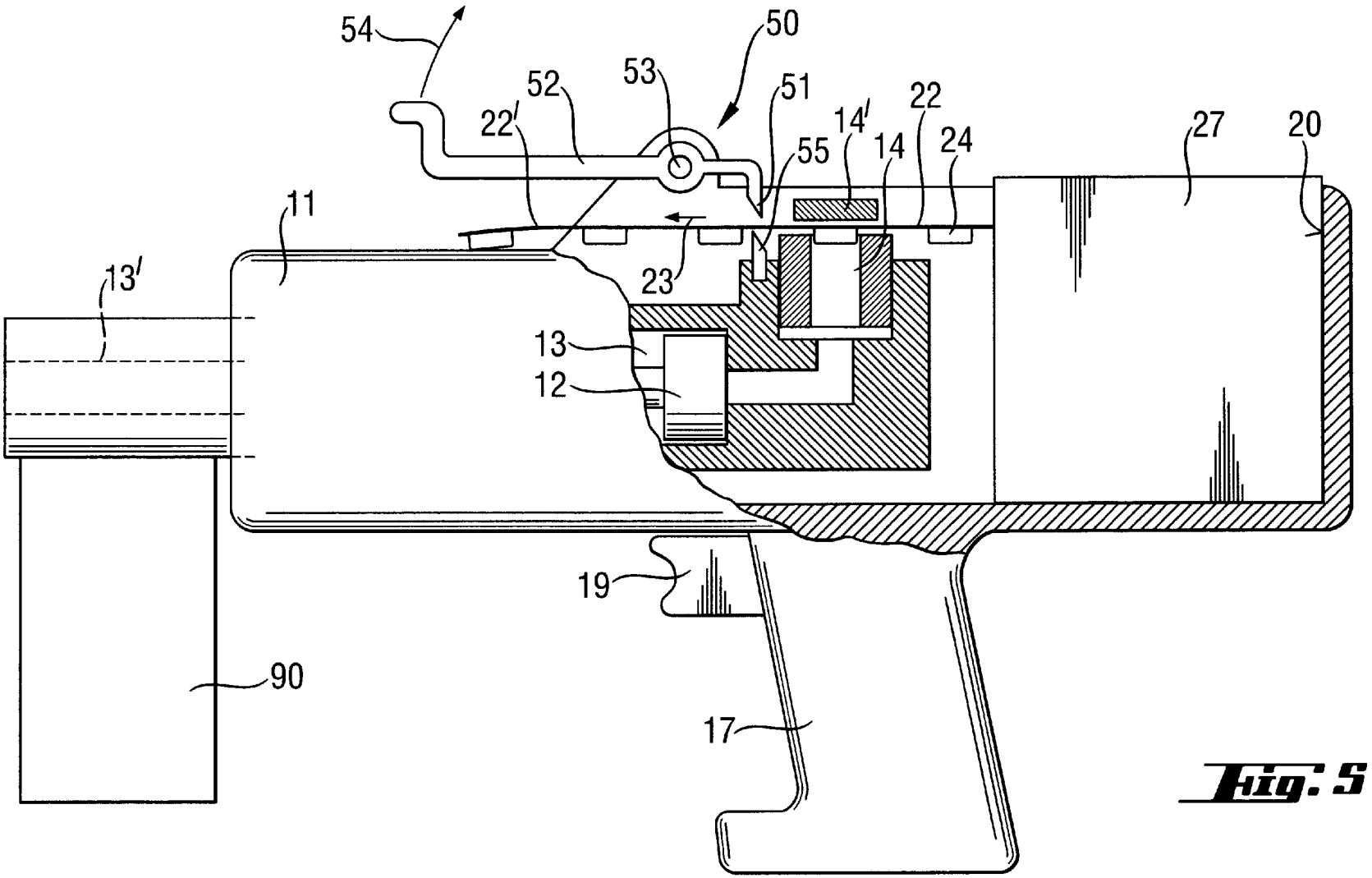
FIG. 5. A schematic, partially cross-sectional side view of a third embodiment of a setting tool according to the present invention in an operational position thereof with magazine of to-be-set fastening elements located in the setting tool.
Figure 6:
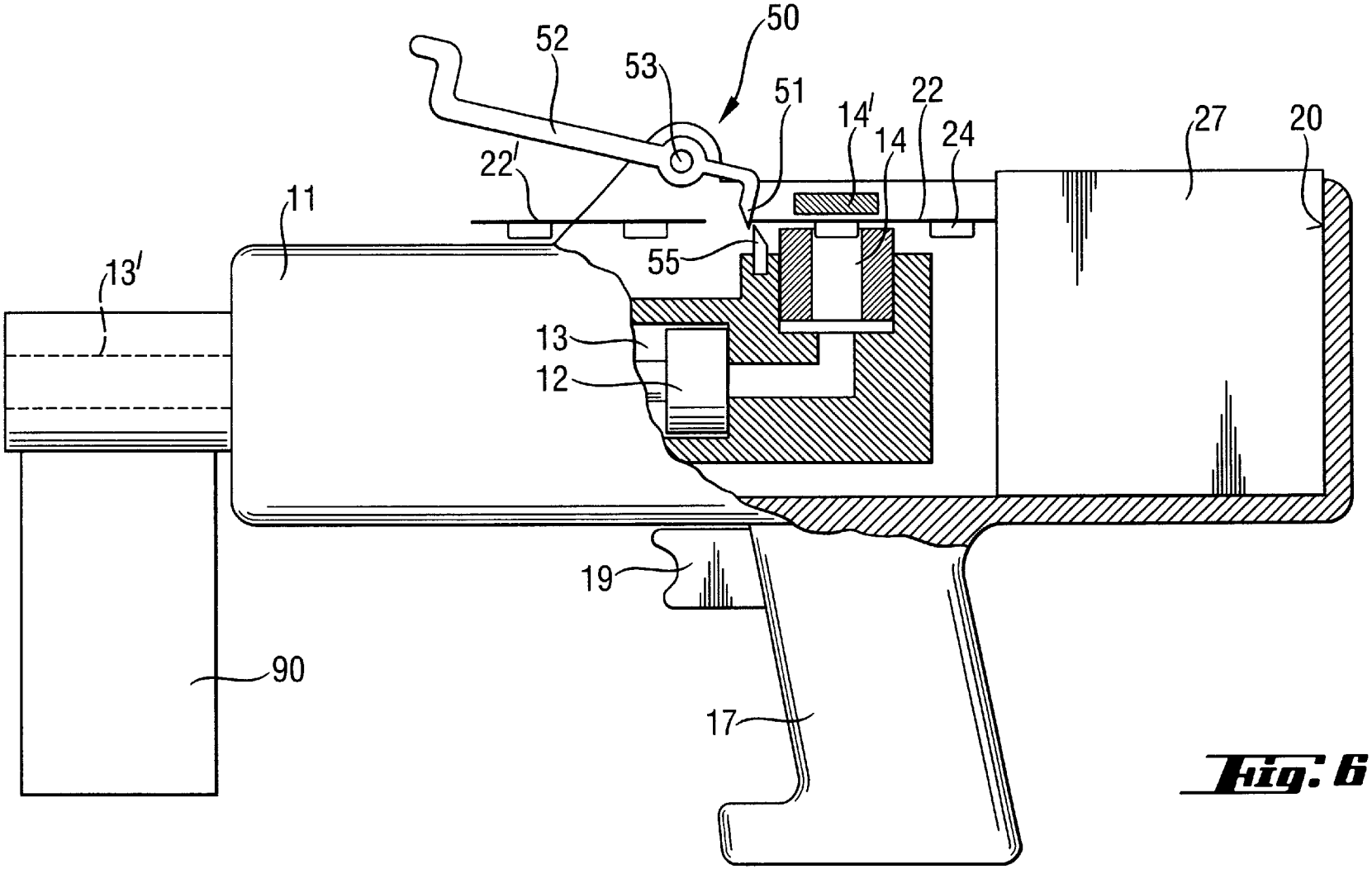
FIG. 6. A schematic, partially cross-sectional, side view of the setting tool shown in FIG. 5 after actuation of the cutting device for a magazine strip.

FIGS. 5 and 6 show a further embodiment of a setting tool according to the present invention. In this embodiment likewise, the magazine box 27 is located in the magazine-receiving means 20 of the housing 11. The housing 11 is formed as a one-price part, and the setting tool is provided with a magazine 90 of to-be-set fastening elements. Above the housing 11, there are provided a pivot lever 50 formed of an actuation/cutting lever 52 and a pivoted blade-shaped cutting member 51. The pivot lever 50 is pivotally supported on a bearing 53. In FIG. 5, the actuation/cutting lever 52 and the cutting member 51 and shown in their non-operational positions. The magazine strip 22 is displaced beneath the cutting member 51 which is arranged, in the displacement direction 23 of the magazine strip 22, behind the cartridge socket 14, as was the case in the embodiment of FIG. 4. It should be noted that the cutting member can be located in front of the cartridge socket (in the displacement direction of a strip). The position of a cutting member depends on a displacement mode of the magazine strip. When the displacement of the magazine strip is effected when the setting tool is pressed against a constructional component, the cutting mechanism can be arranged in front of the cartridge socket in the displacement direction.

In the embodiment shown in FIG. 5, a second blade-shaped cutting member 55 is provided on the other side of the magazine strip 22 and serves as an end support for the cutting member 51. Upon actuation of the pivot lever 50 in a direction of arrow 54 (which corresponds to the cutting movement), the blade-shape cutting member 51 pivots into the displacement path of the magazine strip 22, as shown in FIG. 6. Thus, upon actuation of the lever 52, the end 22' of the magazine strip 22, which extends beyond the setting tool, is cut out from the magazine strip 22.

The actuation/cutting lever 52 can be actuated by the setting tool user when necessary, e.g., when a lengthy piece of the magazine strip extends from the setting tool.

Figure 7:
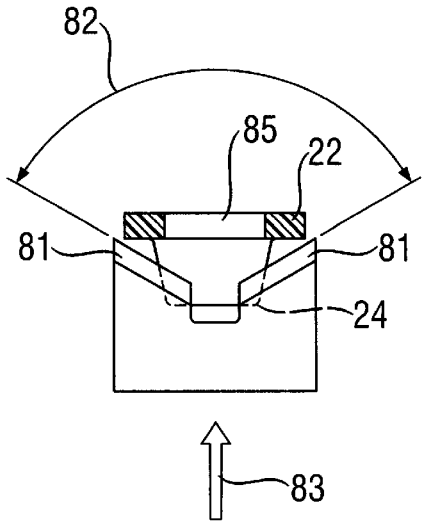
FIG. 7. A schematic cross-sectional view of cutting means according to the present invention and of a magazine strip.
Figure 8:
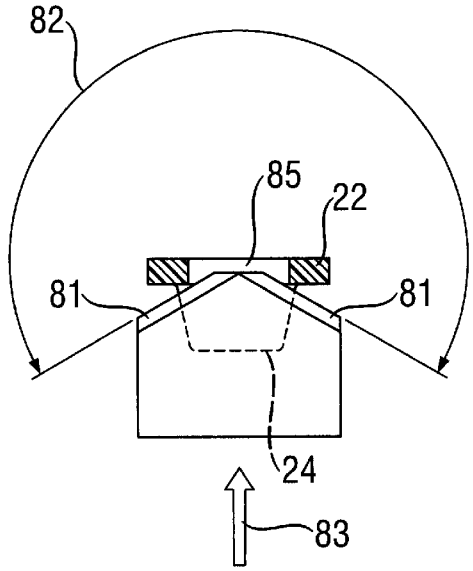
FIG. 8. A schematic cross-sectional view of another embodiment of cutting means according to the present invention and of a magazine strip.

FIGS. 7 and 8 show two other embodiments of cutting means according to the present invention. In the embodiment of FIG. 7, the cutting means has two cutters 81 arranged at an angle 82 to each other, with the angle 82 being less than 180° and forming a V-shaped profile. With this arrangement of cutters 81 relative to each other, the cutting strip 22 can be cut, in the direction of arrow 83, with small expenditure of force.

In the embodiment of FIG. 8, the two cutters 81 are arranged at an angle 82 to each other which is greater than 180°. Both cutter 81 are displaced to a common central point in which they can be displaced into an opening 85 in the magazine strip 22. In this embodiment likewise, due to the inclination of the cutters 81 to the magazine strip 22, the cut is effected in the direction of the arrow 83 without a great expenditure of force. Though cutting means with two cutters were described, the use of a single cutter within an angle of 180° is not, however, excluded.

Figure 9:
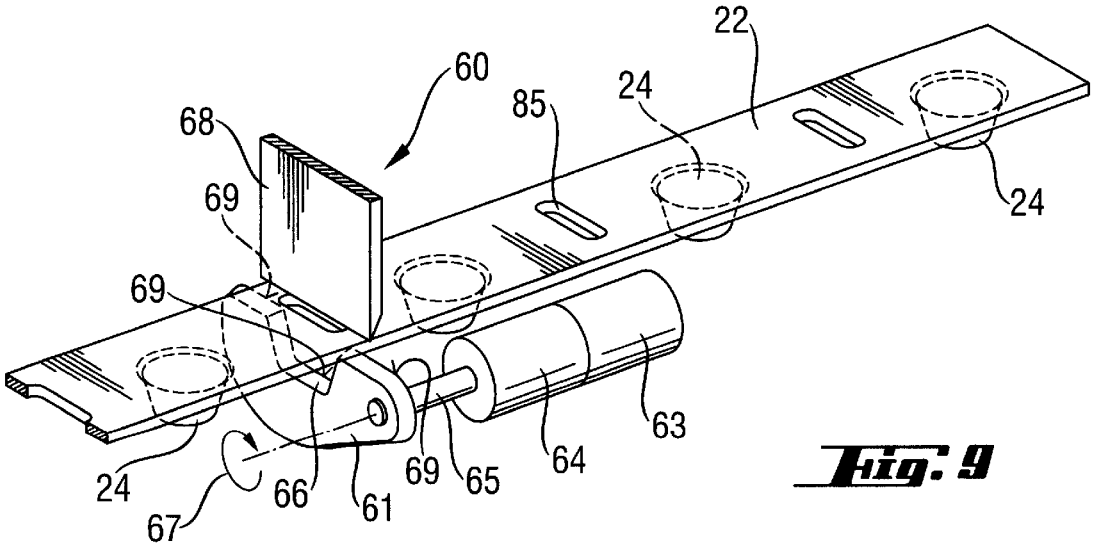
FIG. 9. A schematic view of the cutting device according to the present invention.

FIG. 9 shows another embodiment of cutting device 60 according to the present invention. The cutting device 60 has an electrical drive 63 and a gear set 64 connected with the electrical drive 63 and having an output shaft 65. A rotating blade 61 is arranged on the free end of the shaft 65. The blade 61 had on its circumference a cutter 69 that cuts the magazine strip 22 upon rotation of the blade in the direction of arrow 67. To prevent deflection of the magazine strip 22, a counter support 68, e.g., a second blade, can be provided. The counter support 68 is arranged opposite the rotating blade 61 on the other side of the magazine strip 22. For a free displacement of propellant charges 24 in a rest position of the rotating blade 61, there is provided a recess 66 in the region of the cutter 69.

Figure 10:
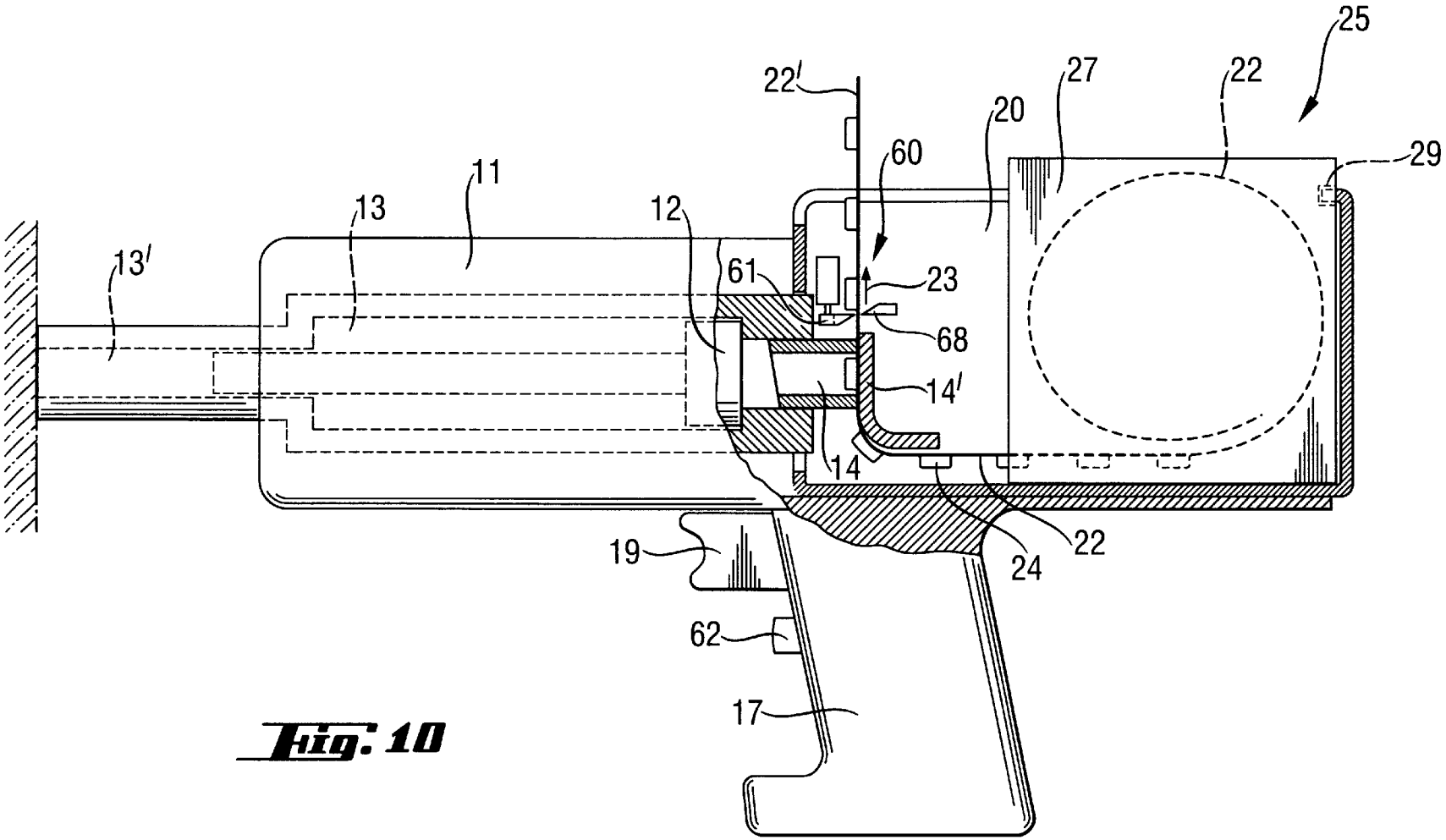
FIG. 10. A schematic, partially cross-sectional, side view of a setting tool according to the present invention with the cutting device shown in FIG. 9 and located in the setting tool.

As shown in FIG. 10, the cutting device 60 is located within the setting tool which corresponds essentially to the setting tool shown in FIGS. 1–3. The magazine box 27 is located in the magazine compartment 21. The cutting device 60 is fixedly connected with the housing 11. Upon withdrawal of the magazine compartment 21 in its withdrawal position, which the magazine box 27 is removed, the cutting of the magazine strip 22 is effected with the rotating blade 61 of the cutting device 60 upon electrical actuation of the drive 63. The control circuit not shown in the drawing, however, the cutting process can be initiated by actuation of an electrical switch 62 provided on the handle 17. However, the electrical control can be activated automatically, e.g., after each setting process or after a predetermined number of setting processes, for actuation of the cutting device 60.

Figure 11:
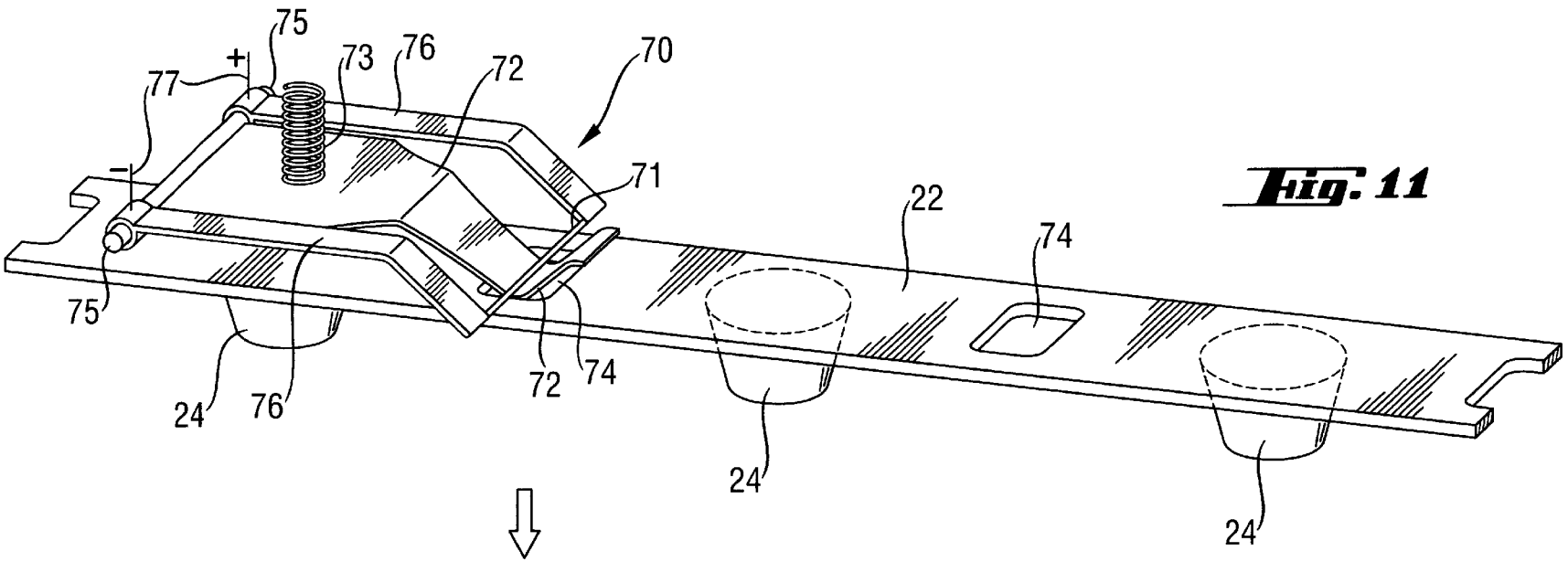
FIG. 11. A perspective view of a further embodiment of a cutting device according to the present invention.
Figure 12:
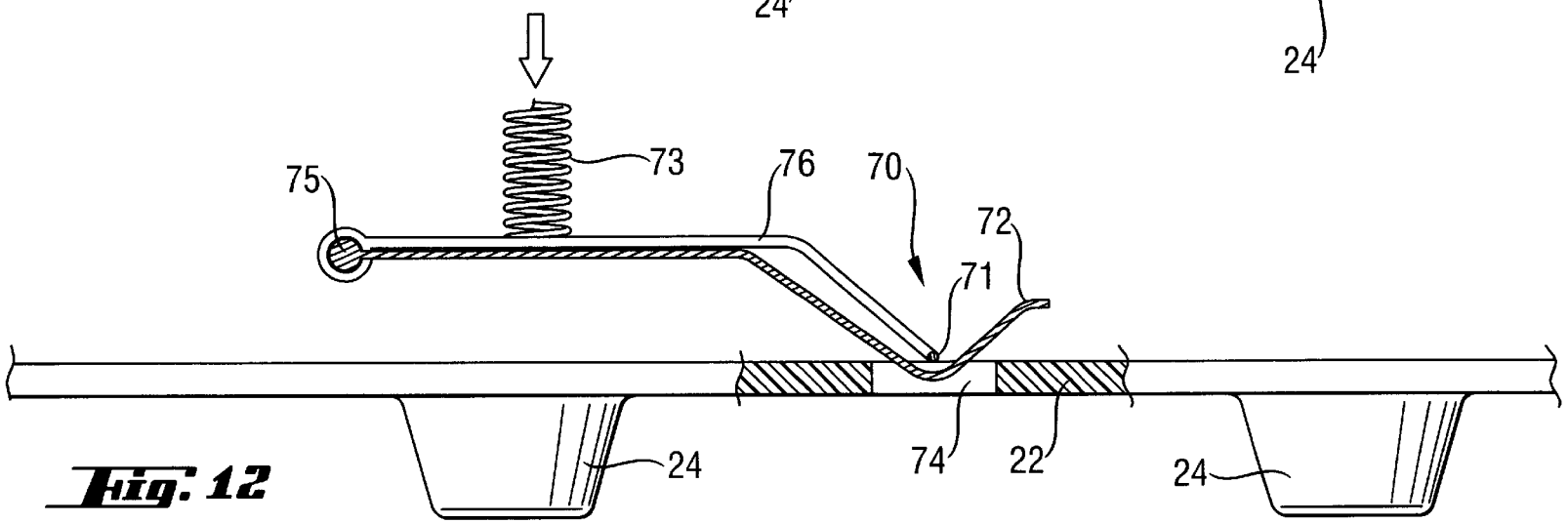
FIG. 12. A cross-sectional view of the cutting device shown in FIG. 11.

FIGS. 11–12 show another embodiment of an electrical cutting device. The electrical cutting device 70, which is shown in FIGS. 11–12, includes a thermal cutting element, e.g., an incandescent wire 71. The cutting device 70 is usually pivotally supported in a setting tool, not shown in FIGS. 11–12, with bearing journals 75. The cutting device 70 includes, in addition to the thermal cutting element, wire 71, a feeler element 72 that is arranged beneath the thermal cutting element, wire 71, at a small distance therefrom. The feeler element 72 is biased by a spring 73 that biases the feeler element 72 in a direction toward a magazine strip 22. Holding elements 76 for the cutting element are fixedly connected, at least regionwise, with the feeler element 72, whereby the thermal cutting wire 71 is also biased in the direction toward the magazine strip 22. The feeler element 72 can be displaced toward, e.g., a cutting mark 74 on the magazine strip 22. A cutting instruction can be communicated to the cutting element, wire 71, by an electronic control system not shown. To this end, on the bearing journals 75, electrical contacts 77 are provided through which current can be fed to the wire 71 to bring it to glow. The magazine strip 22 can be cut as a result of heating with the wire 71.

The cutting can be generally affected in accordance with a predetermined program or be initiated by actuation of an electrical switch provided on the setting tool handle or in another region of the setting tool, upon removal of the wire strip or the magazine box from the setting tool.

Though the present invention was shown and described with the references to the preferred embodiments, such are merely illustrative of the present invention and are not to be construed as limitation thereof and various modifications of the present invention will be apparent to those skilled in the art. It is therefore not intended that the present invention be limited to the disclosed embodiments or details thereof, and the present invention includes all variations and/or alternative embodiments with the spirit and scope of the present invention as defined by the appended claims.

What is claimed is:

1. A propellant charge-operated setting tool for driving in fastening elements, comprising a housing (11); a setting mechanism (12) located in the housing (11) and actuated in response to ignition of a propellant charge (26) for driving in a fastening element; and a device (30, 40, 50, 60, 70) for cutting a propellant charge-carrying magazine strip (22) used in the setting tool.

2. A setting tool according to claim 1, further comprising a cartridge socket (14) for receiving a propellant charge (24) upon a predetermined displacement of the magazine strip (22) through the setting tool, and wherein the cutting device (30) has at least one cutting element (31) behind the cartridge socket (14) in a displacement direction (23) of the magazine strip (22).

3. A setting tool according to claim 2, further comprising magazine-receiving means (21) for receiving the magazine strip (22).

4. A setting tool according to claim 3 wherein the magazine-receiving means is formed as a magazine compartment (21) displaceable between a first position (25) corresponding to an operational position of the setting tool and a second position (26) corresponding to a position of the setting tool in which insertion/removal of the magazine strip (22) is possible.

5. A setting tool according to claim 4, wherein the magazine strip (22) is arranged in a magazine box (27).

6. A setting tool according to claim 4, wherein the cutting element (31) is arranged on the magazine compartment (21)

for displacement therewith, and wherein upon displacement of the magazine compartment (21) from the first position (25) thereof to the second position (26) thereof, the cutting element is displaced through a displacement path (23) of the magazine strip (22).

7. A setting tool according to claim 1, comprising two housing parts (15, 16) movable relative to each other as a result of recoil of the setting tool following ignition of a propellant charge (24), wherein the magazine strip (22) is displaced in one (15) of the housing parts, wherein the cutting device (40) has at least one cutting element (41) arranged on another (16) of the housing parts, and wherein upon relative movement (18) of the two housing parts (15, 16) to each other, the cutting element (41) is displaced through a displacement path (23) of the magazine strip (22).

8. A setting tool according to claim 7, further comprising a damping device (42) arranged between the two housing parts (15, 16) for preventing movement of the two parts (15, 16) relative to each other upon pressing of the setting tool against a component in which a fastening element is to be driven in and for damping the recoil of the setting tool upon the ignition of a propellant charge (24).

9. A setting tool according to claim 8, wherein the damping device (42) comprises a damping element (44) an a spring element (43).

10. A setting tool according to claim 1, wherein the cutting device (50) comprises a manually actuated actuation lever (52) and a pivotal cutting member (51).

11. A setting tool according to claim 10, wherein the actuation lever (52) and the cutting member (51) are formed as a one-piece part pivotally supported for rotation about an axis (53).

12. A setting tool according to claim 1, wherein the cutting device (60, 70) comprises an electronically controlled cutting element (61, 71).

13. A setting tool according to claim 12, wherein the cutting device (60, 70) comprises an electrical switch (62) for manually actuating the cutting element (61, 71) for effecting a cutting process.

14. A setting tool according to claim 12, wherein the cutting device comprises an electrical drive (63) for operating the cutting element.

15. A setting tool according to claim 14, further comprising a gear set (64) associated with the electrical drive (63).

16. A setting tool according to claim 15, wherein the cutting element (61) is formed as a rotating cutting body supported on an output shaft (65) of the gear set (64) for rotation therewith and displaceable through a displacement path (23) of the magazine strip (22).

17. A setting tool according to claim 1, wherein the cutting device (70) comprises a thermal cutting element (71) for cutting the magazine strip (22).

18. A setting tool according to claim 17, wherein the thermal cutting element (71) is formed as an incandescent wire.

19. A setting tool according to claim 17, further comprising spring means (73) for biasing the thermal cutting element (71) toward the magazine strip (22), and a feeler element (72) for sensing a cutting mark (74) on the magazine strip (22) and cooperating with the thermal cutting element (71) for actuating same in response to sensing of the cutting mark (74).

20. A setting tool according to claim 1, wherein the cutting device comprises two cutters (81) inclined toward each other and forming together an angle (82) which is one of less than 180° and greater than 180°.

* * * * *